United States Patent [19]

Glaser et al.

[11] Patent Number: 4,943,018

[45] Date of Patent: Jul. 24, 1990

[54] WALL-MOUNTABLE BACK BRUSH

[76] Inventors: Gary A. Glaser, R.R. 1, Box 231, Ridgeland, Wis. 54763; Garry S. Glaser, 5455 Smetana Dr., Apt. 1215, Minnetonka, Minn. 55343

[21] Appl. No.: 280,839

[22] Filed: Dec. 7, 1988

[51] Int. Cl.[5] ..... A47K 7/02

[52] U.S. Cl. ..... 248/110; 248/206.4; 4/606; 15/160

[58] Field of Search ..... 248/110, 201, 205.5, 248/205.6, 205.7, 205.8, 205.9, 206.1, 206.2, 206.3, 206.4, 309.1, 309.3, 362, 111, 112, 113; 4/606; 15/110, 160, DIG. 5, DIG. 6

[56] References Cited

U.S. PATENT DOCUMENTS

| | | | |
|---|---|---|---|
| D. 260,563 | 9/1981 | Walsh, Jr. | 15/160 |
| 1,267,270 | 5/1918 | Rheinlander . | |
| 1,864,874 | 6/1932 | Voight . | |
| 1,899,242 | 2/1933 | McNab . | |
| 1,954,940 | 4/1934 | Mikel | 15/160 |
| 2,385,977 | 10/1945 | Farmer | 248/205.5 |
| 2,642,603 | 6/1953 | Mills | 248/206.3 |
| 2,717,472 | 9/1955 | Wilmington . | |
| 2,797,886 | 7/1957 | Pinckney | 248/206.3 |
| 2,901,760 | 9/1959 | Nelson | 4/606 |
| 2,904,038 | 9/1959 | Hackney | 15/160 |
| 3,040,337 | 6/1962 | Fjelstad | 15/160 |
| 3,044,088 | 7/1962 | Anderson | 15/160 |
| 3,109,177 | 11/1963 | Grafmyer | 4/606 |
| 3,631,560 | 1/1972 | Atkins | 4/606 |
| 3,750,226 | 8/1973 | Morgan | 4/606 |
| 3,935,611 | 2/1976 | Locher | 15/160 |
| 4,417,362 | 11/1983 | Walker | 4/606 |
| 4,554,609 | 11/1985 | Simmons | 15/160 |
| 4,611,716 | 9/1986 | Sorlien | 206/581 |
| 4,696,447 | 9/1987 | Strecker | 248/309.1 |
| 4,699,127 | 10/1987 | Schley | 4/606 |
| 4,704,759 | 11/1987 | Mesa | 4/606 |
| 4,759,091 | 7/1988 | Kiss | 4/606 |

FOREIGN PATENT DOCUMENTS

| | | | |
|---|---|---|---|
| 680862 | 9/1939 | Fed. Rep. of Germany | 248/206.4 |
| 2917878 | 11/1980 | Fed. Rep. of Germany | 15/160 |
| 1107625 | 1/1955 | France | 248/206.4 |
| 1203916 | 8/1959 | France | 15/DIG. 6 |
| 1360371 | 3/1964 | France | 248/205.5 |
| 44200 | 8/1908 | Switzerland | 15/DIG. 6 |
| 9839 | of 1894 | United Kingdom | 15/DIG. 6 |
| 2123281 | 2/1984 | United Kingdom | 15/160 |

*Primary Examiner*—Alvin C. Chin-Shue
*Assistant Examiner*—Robert A. Olson
*Attorney, Agent, or Firm*—John W. Bunch

[57] ABSTRACT

A wall-mountable back brush (10) comprises a base (12), bristles (14, 16) thereon, and suction cups (20) secured thereto in adjustable spaced apart relationship. The base (12) is preferably curved in accordance with the curvature of the lumbar region.

9 Claims, 2 Drawing Sheets

WALL-MOUNTABLE BACK BRUSH

TECHNICAL FIELD

The present invention relates generally to brushes, and more particularly to a back brush which can be adjustably positioned and removably secured by suction cups on the wall of a tub or shower enclosure.

BACKGROUND ART

Back brushes generally take the form of a brush with a long handle by which the user can reach around and scrub his or her own back. Back brushes with both fixed and detachable handles have been available heretofore. Although such back brushes have been generally satisfactory, they have not been without some drawbacks due to their manner of use. It will be appreciated that a fair amount of physical flexibility and coordination is required for their effective use. People with stiff necks, backs, shoulders, or other joints may not be able to use such back brushes, or if so only with difficulty. Moreover, the typical back brush of the prior art is relatively small and flat and is only suited for relatively localized scrubbing over a limited area with limited pressure. Various holders have been available heretofore for holding soap, toothbrushes and the like. For example, U.S. Pat. Nos. 4,696,447 to Strecker, 2,797,886 to Pinckney, and 2,642,603 to Mills are representative of the prior art in this area. However, there has not been available a wall-mountable back brush.

There is thus a need for a back brush which can be conveniently mounted in adjustable position on the wall of a tub or shower enclosure.

SUMMARY OF THE INVENTION

The present invention comprises a wall-mountable back brush which overcomes the foregoing and other difficulties associated with the prior art. In accordance with the invention, there is provided a back brush including an elongate base having bristles on one side thereof. The base is preferably curved to fit the curvature of the lumbar area of the spine. The bristles preferably include an arrangement of both soft and relatively stiff bristles, one type surrounded by the other. The brush can be attached to the wall of a tub or shower unit by means of a suction cup arrangement, which is preferably adjustable.

BRIEF DESCRIPTION OF THE DRAWING

A better understanding of the invention can be had by reference to the following Detailed Description in conjunction with the accompanying Drawing, wherein.

DETAILED DESCRIPTION

Figure 1:
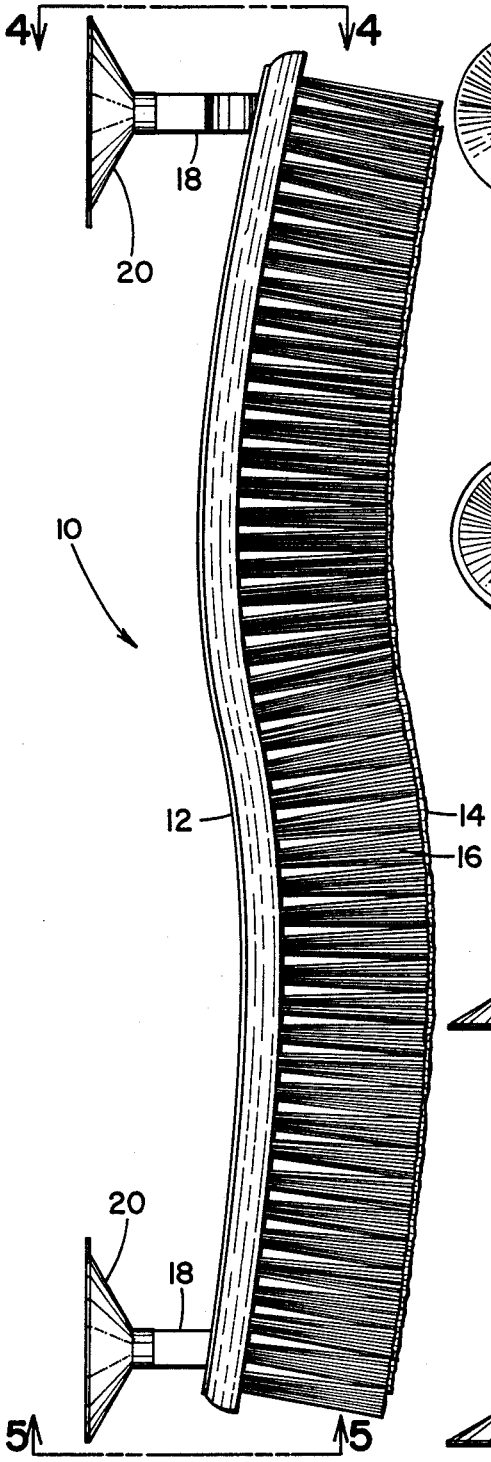
FIG. 1 is a side view of the wall-mountable back brush of the present invention.
Figure 2:
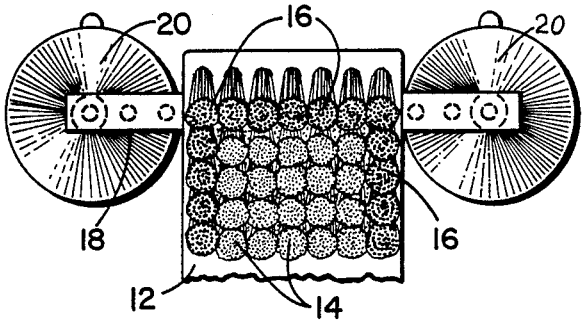
FIG. 2 is a front view of one end of the brush.
Figure 3:
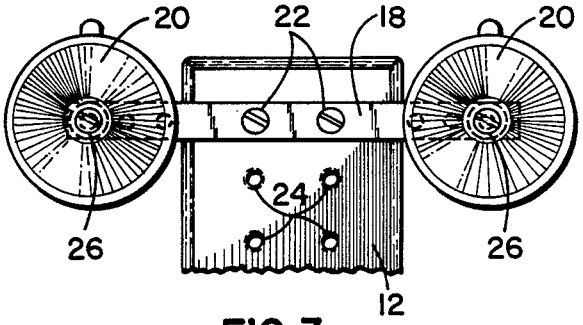
FIG. 3 is a rear view of one end of the brush.
Figure 4:
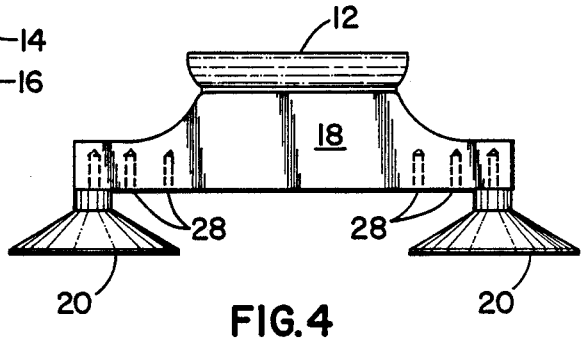
FIG. 4 is a top end view of the brush taken generally along lines 4—4 of FIG. 1 in the direction of the arrows.
Figure 5:
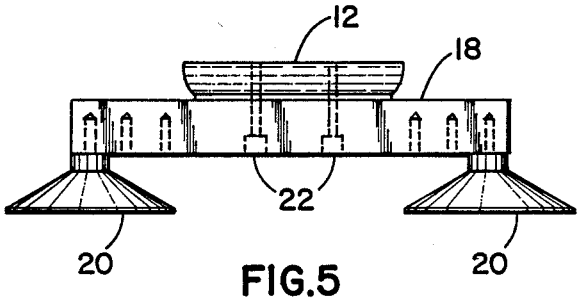
FIG. 5 is a bottom end view of the brush taken generally along lines 5—5 of FIG. 1.

Referring now to the Drawing, wherein like reference numerals designate like or corresponding elements throughout the views, and particularly referring to FIGS. 1–5, there is shown the wall-mountable back brush 10 of the invention. As will be explained more fully hereinafter, the back brush 10 is adapted for convenient mounting in adjustable fixed position on the wall of a tub or shower enclosure in order to avoid the drawbacks of the prior back brushes.

The back brush 10 comprises an elongate base 12 with an arrangement of bristles 14 and 16 on one said thereof. The base 12 can be formed of plastic or other suitable material, in order to resist corrosion. In accordance with the preferred embodiment, the base 12 is sufficiently long to contact a substantial portion of the human back, and is curved at one end to fit the curvature of the lumbar region. Bristles 14 and 16 are preferably of different relative sniffinesses. In accordance with the preferred embodiment, the inner bristles 14 are relatively stiffer or less flexible than the outer surrounding bristles 16 for better scrubbing action. In addition, the inner bristles 14 are preferably relatively longer than the outer bristles 16, as best seen in FIG. 1. The bristles 14 and 16 can be formed of any suitable material, such as nylon, and are secured to base 12 in conventional fashion. If desired, bristles 14 and 16 can be of contrasting colors.

The back brush 10 is mounted on the wall by means of braces 18 and suction cups 20. One transverse brace 18 is provided at each end of base 12, on the side opposite that of bristles 14 and 16. Braces 18 can also be formed of plastic or other suitable material, in order to resist corrosion. In accordance with the preferred construction, at least one of the brackets 18 is secured to base 12 for adjustable positioning for best mounting, such as for example, in the case of a ceramic tile bath or tub enclosure. Screws 22 extending through brace 18, and pairs of spaced apart mounting holes 24 in the base 12 are provided for this purpose. Similarly, resilient suction cups 20 are provided at opposite ends of the braces 18. The suction cups 20 can be secured in fixed positions, but are preferably secured in adjustable positions by means of screws 26 and mounting holes 28 as shown.

Figure 6:
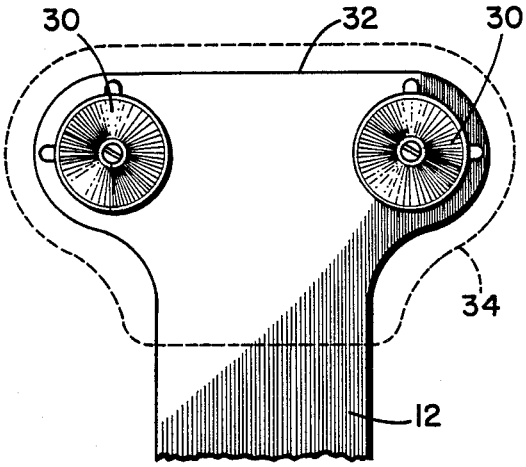
FIG. 6 is a back view of one end of a modified brush.
Figure 8:
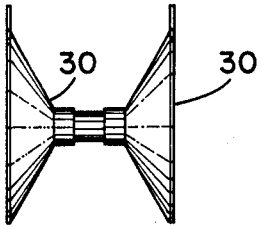
FIG. 8 is an illustration of a double suction cup.
Figure 7:
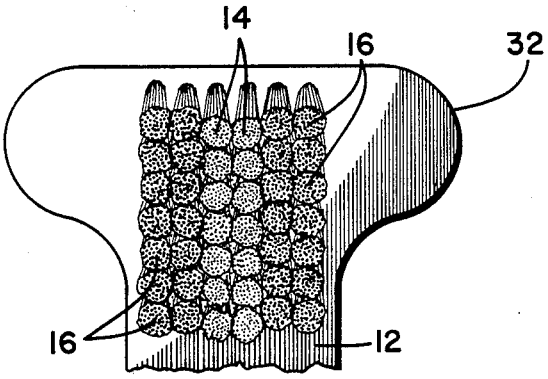
FIG. 7 is a front view of one end of the modified brush shown in FIG. 6.

Referring now to FIGS. 6–8, there is shown a modification to the mountable back brush 10. Instead of transverse braces 18 and single-sided suction cups 20, at least one double-sided suction cup 30 can be used directly on each end of the base 12. As shown, two double-sided suction cups 30 are provided on the enlarged end portions 32 of base 12, however, it will be understood that only one such suction cup could be used if desired. This arrangement readily permits adjustment of the suction cups 30, both on the base 12 as well as on the wall of the tub or shower enclosure. With this arrangement, the suction cups 30 could be left on other wall of the tub or shower enclosure, so that the branch 10 can be removed between uses. The dotted line 34 in FIG. 6 represents the area over which the suction cups 30 can be adjusted. Also, instead of the inner bristles 14 being framed on all four sides by the outer bristles 16, the bristles can be arranged in columns as shown in FIG. 7, if desired.

It will thus be appreciated that the present invention comprises a wall-mountable back brush having several advantages over the prior art. The back brush herein can be conveniently secured to the wall of virtually any tub or shower enclosure, at any desired height depending upon the user. If the wall of the tub or shower enclosure is comprised of separate tiles, the spacing between the suction cups can be varied accordingly for secure mounting. The brush is preferably curved in accordance with the curvature of the lumbar region. Other advantages will be evident to those skilled in the art.

Although particular embodiments of the invention have been illustrated in the accompanying Drawing and described in the foregoing Detailed Description, it will be understood that the invention is mot limited only to the embodiments disclosed, but is intended to embrace any alternatives, equivalents, modifications and/or rearrangements of elements falling within the scope of the invention as defined by the following Claims.

What is claimed is:

1. A wall-mountable back brush, comprising:

an elongate base having opposite sides and opposite top and bottom ends;

said base being of generally S-shaped continuous curvature between the top and bottom ends in order to fit the lumbar region;

bristles secured to one side of said base;

a plurality of suction cups;

a pair of braces, one at each end of said base; and means for securing said braces to said base in adjustable, spaced apart relationship;

at least one suction cup being provided on each brace.

2. The back brush of claim 1, wherein two suction cups are provided on each brace, and further including:

means for securing said suction cups to their respective braces in adjustable, spaced apart relationship.

3. The back brush of claim 1, wherein said bristles comprise:

first bristles centrally arranged on said one side of said base; and second bristles peripherally arranged around said first bristles, said second bristles being relatively shorter than said first bristles.

4. The back brush according to claim 3, wherein said first and second bristles are of different relative stiffnesses.

5. The back brush according to claim 4, wherein said second bristles are less stiff than said first bristles.

6. A wall-mountable back brush, comprising:

an elongate base having opposite sides and opposite top and bottom ends;

said base being of generally S-shaped continuous curvature between the top and bottom. ends in order to fit the lumbar region;

a bristle arrangement secured to one side of said base;

said bristle arrangement including first and second bristles of different relative stiffnesses and lengths, the first bristles being arranged centrally with the second bristles framing the first bristles;

a plurality of suction cups;

a pair of braces, one at each end of said base; and means for securing said braces to said base in adjustable, spaced apart relationship;

at least one suction cup being provided on each brace.

7. The back brush of claim 6, wherein two suction cups are provided on each brace, and further including:

means for securing said suction cups to their respective braces in adjustable, spaced apart relationship.

8. The back brush of claim 6, wherein each suction cup is individually secured to said braces by means of a second suction cup in back-to-back relationship.

9. A wall-mountable back brush, comprising:

an elongate base having opposite sides and opposite top and bottom end portions;

the end portions of said base being enlarged and relatively wider than the portion of said base therebetween;

said base being of generally S-shaped continuous curvature between the top and bottom ned portions in order to fit the lumbar region;

a bristle arrangement secured to one side of said base;

said bristle arrangement including first and second bristles of different relative stiffnesses and lengths, the first bristles being arranged centrally with the second bristles framing the first bristles; and a plurality of double-sided suction cups secured to the other side of said base in adjustable spaced apart relationship in two directions;

at least one double-sided suction cup being provided on each end portion of said brace.

* * * * *